US010286262B1

(12) United States Patent
Yost

(10) Patent No.: US 10,286,262 B1
(45) Date of Patent: May 14, 2019

(54) GOLF EQUIPMENT WASHING MECHANISM FOR USE ON CONVENTIONAL GOLF BALL WASHERS

(71) Applicant: Vincent G. Yost, Harleysville, PA (US)

(72) Inventor: Vincent G. Yost, Harleysville, PA (US)

( * ) Notice: Subject to any disclaimer, the term of this patent is extended or adjusted under 35 U.S.C. 154(b) by 0 days.

(21) Appl. No.: 15/397,369

(22) Filed: Jan. 3, 2017

Related U.S. Application Data

(60) Provisional application No. 62/328,794, filed on Apr. 28, 2016.

(51) Int. Cl.
*A63B 47/04* (2006.01)
*A63B 57/60* (2015.01)
*B05B 11/00* (2006.01)

(52) U.S. Cl.
CPC ..... *A63B 47/04* (2013.01); *A63B 57/60* (2015.10); *B05B 11/3001* (2013.01); *B05B 11/3045* (2013.01)

(58) Field of Classification Search
CPC ..... A63B 47/04; A63B 57/60; B05B 11/3001; B05B 11/3045; B05B 11/3047; B05B 9/043; F04B 23/028; F04B 9/14
See application file for complete search history.

(56) References Cited

U.S. PATENT DOCUMENTS 100,393 A * 3/1870 Gray ..... B05B 11/3015 222/385
RE6,396 E * 4/1875 Gary ..... 222/111
163,289 A * 5/1875 Wolcott ..... B65D 47/40 222/111
1,517,805 A 12/1924 Spaeth
1,517,806 A 12/1924 Spaeth
2,344,005 A * 3/1944 Sundholm ..... F04B 9/14 222/382
2,499,061 A 2/1950 Gray
2,608,705 A * 9/1952 Duff ..... A63B 47/04 15/160

(Continued)

OTHER PUBLICATIONS

Putting Green—Golf Ball Washer—Deluxe Ensemble—Par Aide Blue, https://www.amazon.com/Putting-Green-Washer-Deluxe-Ensemble/dp/B0025QRF0U?SubscriptionId=AKIAIKOHFALUJCKC3KXQtag=bdyahoo-desk-20&linkCode=xm2&camp=2025&creative=165953&creativeASIN=B0025QDRF0U&m=AN2GJJAXKHGZY, Oct. 7, 2016.

(Continued)

*Primary Examiner* — David P Angwin
*Assistant Examiner* — Bob Zadeh
(74) *Attorney, Agent, or Firm* — Caesar Rivise, PC

(57) ABSTRACT

A device, method and kit for replacing the lid and brush assembly of a conventional golf ball washer to easily convert it to an eco-friendly item washing device is provided. The invention involves a top having an insert sized to fit on top of the head of the conventional golf ball washer and having a pump assembly releasably secured thereon. The lid/brush assembly of the conventional washer is removed and the contaminated water of the head is drained and a cleaning solution is poured therein. The invention is then positioned on top of the head and releasably secured thereon. The invention includes a nest to receive a "dirty" golf ball therein. When placed in the nest, the user activates a pump to dispense the cleaning solution directly onto the ball or other golf item, in a limited delivery of cleaning solution to the dirty item to reduce waste.

14 Claims, 9 Drawing Sheets

(56) References Cited

U.S. PATENT DOCUMENTS

| | | | | | |
|---|---|---|---|---|---|
| 2,807,037 | A * | 9/1957 | Garske | A63B 47/04 | 15/21.1 |
| 3,078,471 | A * | 2/1963 | Knibb | A47K 5/1205 | 222/146.5 |
| 3,304,659 | A * | 2/1967 | Eichhorn | A63B 47/04 | 15/21.2 |
| 4,210,974 | A * | 7/1980 | Stoltzman | A63B 47/04 | 15/21.2 |
| 4,350,457 | A * | 9/1982 | Carnahan | A63B 57/60 | 15/104.92 |
| 4,701,968 | A | 10/1987 | Stoltzman | | |
| 5,056,946 | A * | 10/1991 | Larkin | A63B 47/04 | 401/11 |
| 5,184,751 | A | 2/1993 | Middleton | | |
| 5,269,615 | A | 12/1993 | Lewis, Jr. | | |
| 5,350,087 | A | 9/1994 | Frazier et al. | | |
| 5,806,122 | A | 9/1998 | Bogle et al. | | |
| 6,032,312 | A | 3/2000 | Hope et al. | | |
| 6,216,920 | B1 | 4/2001 | Baggett | | |
| 6,269,509 | B1 | 8/2001 | Mays | | |
| 6,282,741 | B1 | 9/2001 | Manning | | |
| 8,795,438 | B2 | 8/2014 | Rubin et al. | | |
| 2001/0035429 | A1* | 11/2001 | Colquhoun | A47K 5/12 | 222/93 |
| 2002/0079380 | A1 | 6/2002 | Presson | | |
| 2003/0000553 | A1* | 1/2003 | Murray | A63B 47/04 | 134/33 |
| 2008/0135581 | A1* | 6/2008 | Kennedy | B05B 11/3009 | 222/205 |
| 2009/0020552 | A1* | 1/2009 | van der Heijden | B05B 7/0037 | 222/190 |
| 2010/0043850 | A1 | 2/2010 | Kiener | | |
| 2011/0272432 | A1* | 11/2011 | Baughman | B05B 7/0037 | 222/136 |
| 2014/0101875 | A1 | 4/2014 | Fengel | | |

OTHER PUBLICATIONS

Perfect Solutions Motorized Golf Ball Cleaner, https://www.amazon.com/Perfect-Solutions-Motorized-Golf-Cleaner/dp/B000C7LQPO, Sep. 15, 2016.

Aerospray Stethoscope Sterilizer, https://www.changemakers.com/innovations4health/entries/aerospray-stethoscope-sterilizer, Sep. 15, 2016.

Rieke Dispensing Unveils New Foamer Dispensers, http://www.packagingnews.co.uk/news/rieke-dispensing-unveils-new-foamer-dispensers-13-09-2012, Sep. 13, 2012.

GOJO 5261-02 FMX-20 Luxury 2000 mL Cranberry Foaming Hand Soap, http://www.webstaurantstore.com/gojo-5261-02-fmx-20-luxury-2000-ml-cranberry-foaming-hand-soap/999G526102.html?utm_source=Google&utm_medium=cpc&utm_campaign=GoogleShopping&gclid=CN3vyq7Hs9ICFZuCswodF7sEgA, Feb. 28, 2017.

* cited by examiner

GOLF EQUIPMENT WASHING MECHANISM FOR USE ON CONVENTIONAL GOLF BALL WASHERS

CROSS-REFERENCE TO RELATED APPLICATIONS

This non-provisional application claims the benefit under 35 U.S.C. § 119(e) of Application Ser. No. 62/328,794 filed on Apr. 28, 2016 entitled GOLF BALL WASHING MECHANISM FOR USE ON CONVENTIONAL GOLF BALL WASHING MACHINES and whose entire disclosure is incorporated by reference herein.

BACKGROUND OF THE INVENTION

The present invention relates to golf ball washers and more particularly to a kit for replacing the head of existing golf ball washers with a more sanitary and environmentally-friendly cleaning mechanism.

As shown most clearly in FIG. 1, popular current golf ball washers 1 comprise a top portion 2, including an associated heavy-brush assembly 3 (FIG. 2A), which are respectively positioned on top and inside a "head" 4 which typically contains water (not shown). See, for example, U.S. Pat. No. 2,807,037 (Garske), which is also incorporated by reference herein. To wash a golf ball (not shown), a gripping knob 3A (at the upper end of the heavy brush assembly 3) is pulled upward, the dirty golf ball inserted in the brush assembly 3, and then the brush assembly 3 with the golf ball are "aggressively" reciprocated up and down to "clean" the dirty golf ball through repeated reciprocations by the golfer, until the golf ball is deemed clean. The golfer can then dry off the ball using the towels 5 hanging on either side of the post 6 supported on a base 7.

However, this design has several inherent flaws: (1) the water gets progressively more dirty and filthy with each use; (2) sunlight, warmth and water cause bacteria growth which often causes the water to become increasingly foul-smelling and germ-concentrated; (3) this bacteria often lingers on a golfer's hands which can be transferred to food or other people, putting everyone at risk for illness; (4) the many parts often become rusty, break and need replacing; (5) because the water becomes progressively more dirty and foul-smelling with every use, loss of water due to splashing, and often mechanical break downs, these conventional ball washers need constant attention for refilling, cleaning and mechanical repair; and (5) the only golf-related item that can be cleaned using this design is a golf ball; no other golf related equipment can be cleaned with a conventional cleaning mechanism (other than with the towels 5).

Thus, there remains a need for a golf ball cleaning mechanism that can be used with these conventional golf ball washers but which do not suffer from the above-identified problems and wherein this cleaning mechanism can be easily installed for a variety of differently-shaped heads of these conventional golf ball washers.

All references cited herein are incorporated herein by reference in their entireties.

BRIEF SUMMARY OF THE INVENTION

A device is disclosed for converting a conventional golf ball washer having a lid with a heavy brush assembly installed in a golf ball washer head into a more environmentally-friendly, multi-golf item cleaning device. The device comprises: a top, adapted for replacing the lid with the heavy brush assembly, and wherein the top comprises a pump assembly having an intake line that is adapted to be positioned within the head containing a cleaning solution (e.g., a foaming soap solution). The pump assembly comprises a spout for delivering a predetermined amount of a cleaning solution to an item positioned under the spout.

A method is disclosed for converting a conventional golf ball washer having a lid with a heavy brush assembly installed in a golf ball washer head into a more environmentally-friendly, multi-golf item cleaning device. The method comprises: removing the lid having the heavy brush assembly from the head; draining the head of any contaminated liquid within the head; filling the head with a cleaning solution (e.g., a foaming soap solution); and positioning a top having a pump assembly thereon onto the head such that an intake line of said pump assembly is disposed in the cleaning solution and a spout of the pump assembly is available for dispensing the cleaning solution.

A kit is disclosed for converting a conventional golf ball washer having a lid with a heavy brush assembly installed in a golf ball washer head into a more environmentally-friendly, multi-golf item cleaning device. The kit comprises: a top, adapted for replacing the lid having the heavy brush assembly, wherein the top comprises a pump assembly having an intake line that is adapted to be positioned within the head; and a container of cleaning solution (e.g., a foaming soap solution), and wherein the cleaning solution is poured into the head before the top is installed on the head.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1:
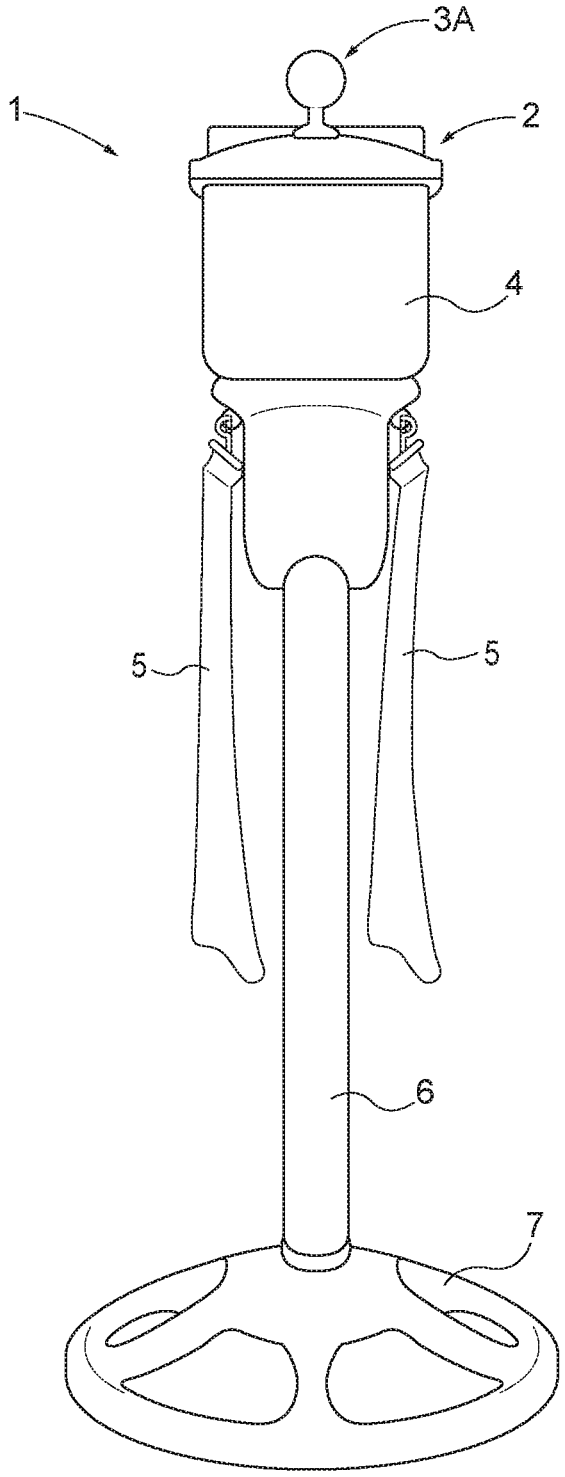
FIG. 1 (Prior Art)
FIG. 1 is a side view of an exemplary prior art conventional golf ball washer.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 2A:
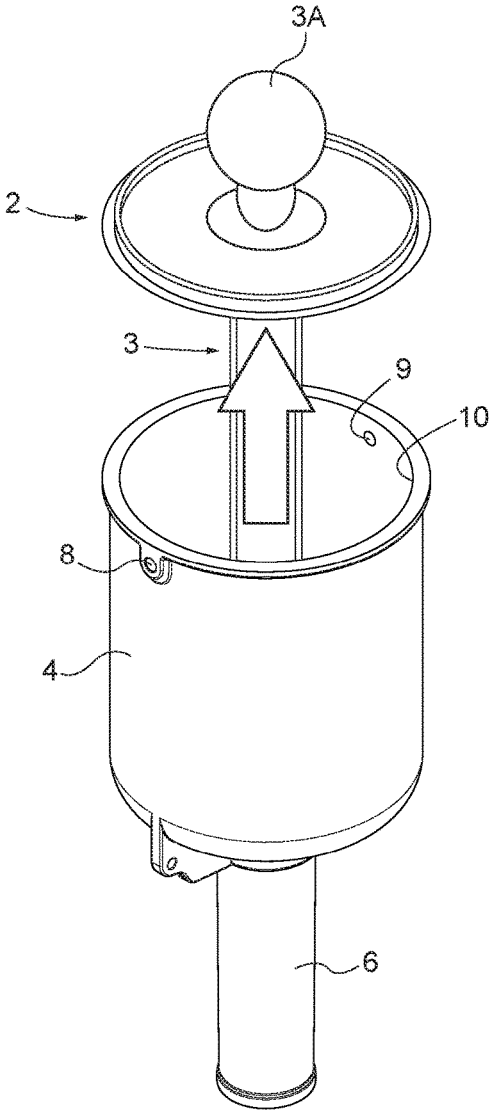
FIG. 2A (Prior Art)
FIG. 2A is a partial isometric view of the conventional golf ball washer of FIG. 1 showing the top and heavy brush assembly being removed.
Figure 2B:
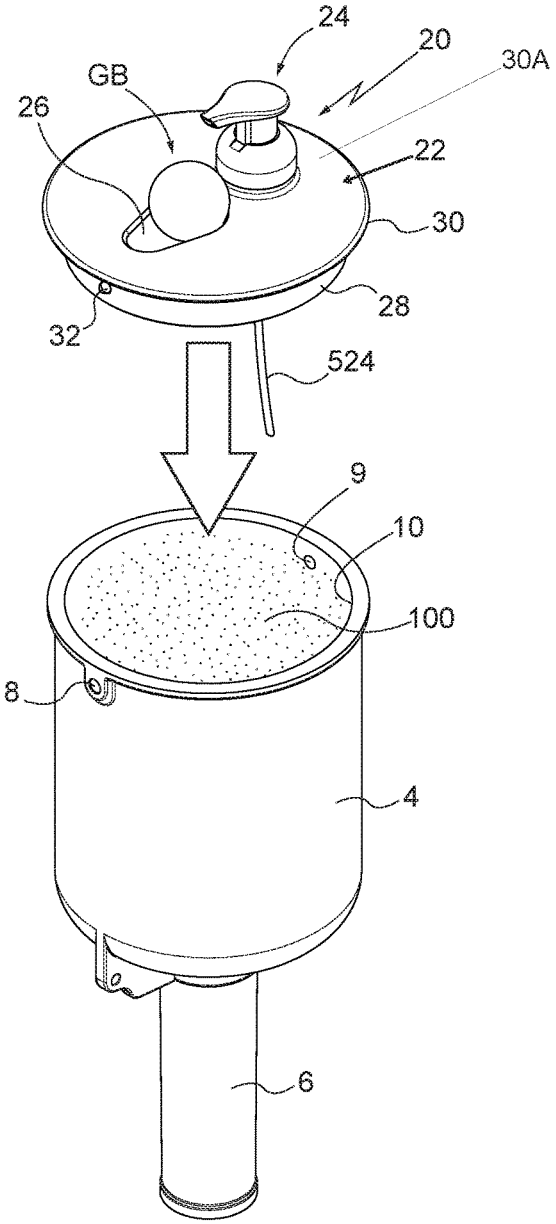
FIG. 2B is an isometric view showing the present invention replacing the top and heavy brush assembly on the same "head" of the conventional golf ball washer but after the contaminated water in the head has been replaced with a cleaning solution.
Figure 3:
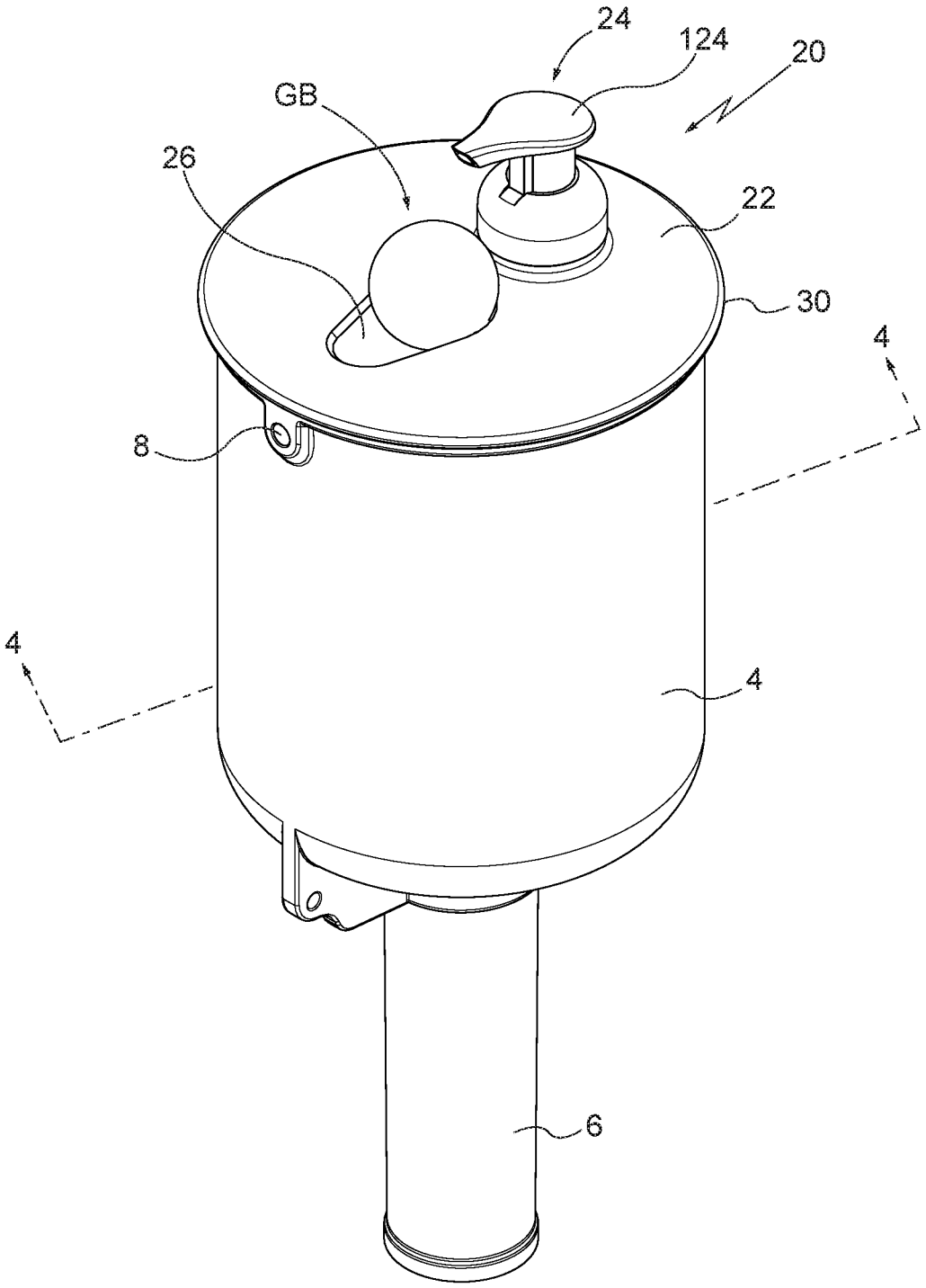
FIG. 3 is an isometric view of the present invention installed on the head of the conventional golf ball washer.
Figure 4:
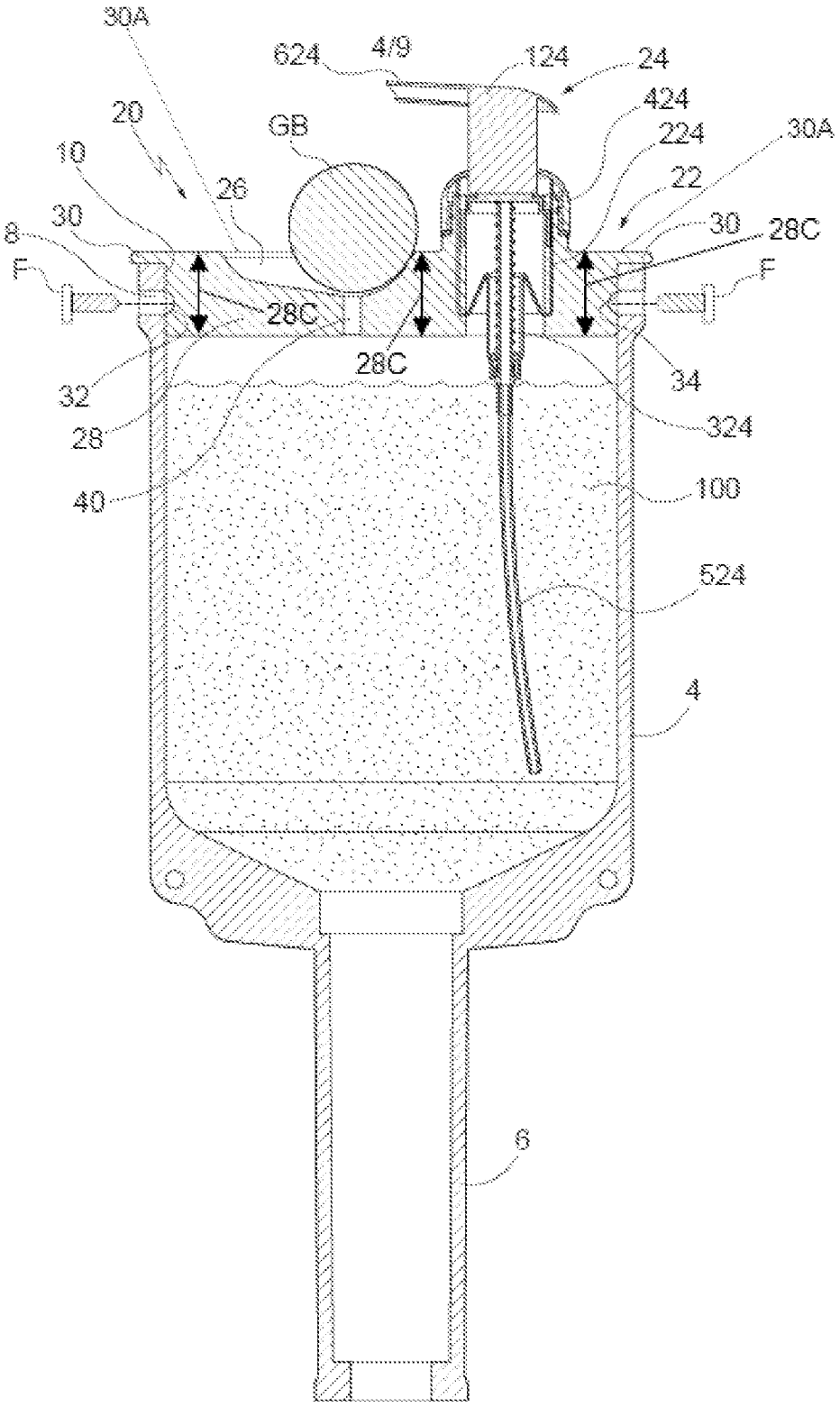
FIG. 4 is a cross-sectional view of the present invention installed on the head of the conventional golf ball washer taking along line 4-4 of FIG. 3.

As shown in FIG. 3, the top portion 2 and associated heavy-brush assembly 3 of a "round" head 4 have been removed and replaced with the present invention 20. The present invention 20 comprises a top 22 having a pump dispenser 24 as well as a golf ball nest 26 for receiving a golf ball GB therein. The top 22 may comprise an aluminum material, although other materials can be used and the present invention 20 is not limited to that material. As can be seen in FIGS. 2B and 4-5A, the top 22 further comprises a circular insert 28 that fits snugly within the circular opening 10 of the head 4 while the outer edge 30 of the top 22 forms a "shoulder" that rests on top of the head 4 opening (FIG. 4). To releasably secure the top 22 to the head 4, a pair of apertures 32 and 34 align with respective apertures 8 and 9 in the head 4. A fastener F (e.g., a set screw, a bolt, a pin, etc., see FIG. 4) can then be inserted in each pair of aligned apertures and hand-tightened to releasably secure the top 22 within the opening to the head 4. As shown most clearly in FIGS. 2B and 4, the insert 28 has an upper planar surface 30A that is contiguous with outer edge 30A. The insert 28 downwardly-depends from the upper planar surface 30A in a uniform thickness 28A, as shown most clearly in FIG. 4. The upper planar surface 30A resides above the head 4 when the present invention 20 is positioned on the head 4. The upper planar surface 30A and insert 28 comprise the nest 26.

As can be appreciated most clearly from FIG. 4, the outer edge 30 forms a "low profile" top 22 such that the top 22 does not project significantly above the head 4 when installed thereon.

The pump dispenser 24 (e.g., F6 Series, 40 mm, Foamer from Rieke Packaging, part #AAF6S08D) comprises a displaceable pump head 124, pump body 224, spring 324, threaded collar 424, intake tube 524, and spout 624. All of these components are well-known in the industry and, as such, are not discussed in any further detail. The threaded collar 424 releasably engages corresponding threads 36 (FIG. 5A) on the pump opening 38 in the top 22. The spout 624 is positioned over the golf ball nest 26 for dispensing the cleaning solution over the dirty golf ball GB placed in the nest 26. It should be noted that, as with most hand/finger activated pumps, the pump head 124 can be rotated 360°, although it is typically positioned over the golf ball nest 26. A small drain passageway 40 is provided from the golf ball nest 26 at its lowest point through the insert 28 (see FIG. 4) to prevent rain water, melting snow, etc., or excess foaming soap from collecting in the golf ball nest 26. The excess foaming soap and rain water, or other accumulated water have no measurable impact on the cleaning solution 100 contained within the head 4.

Figure 6A:
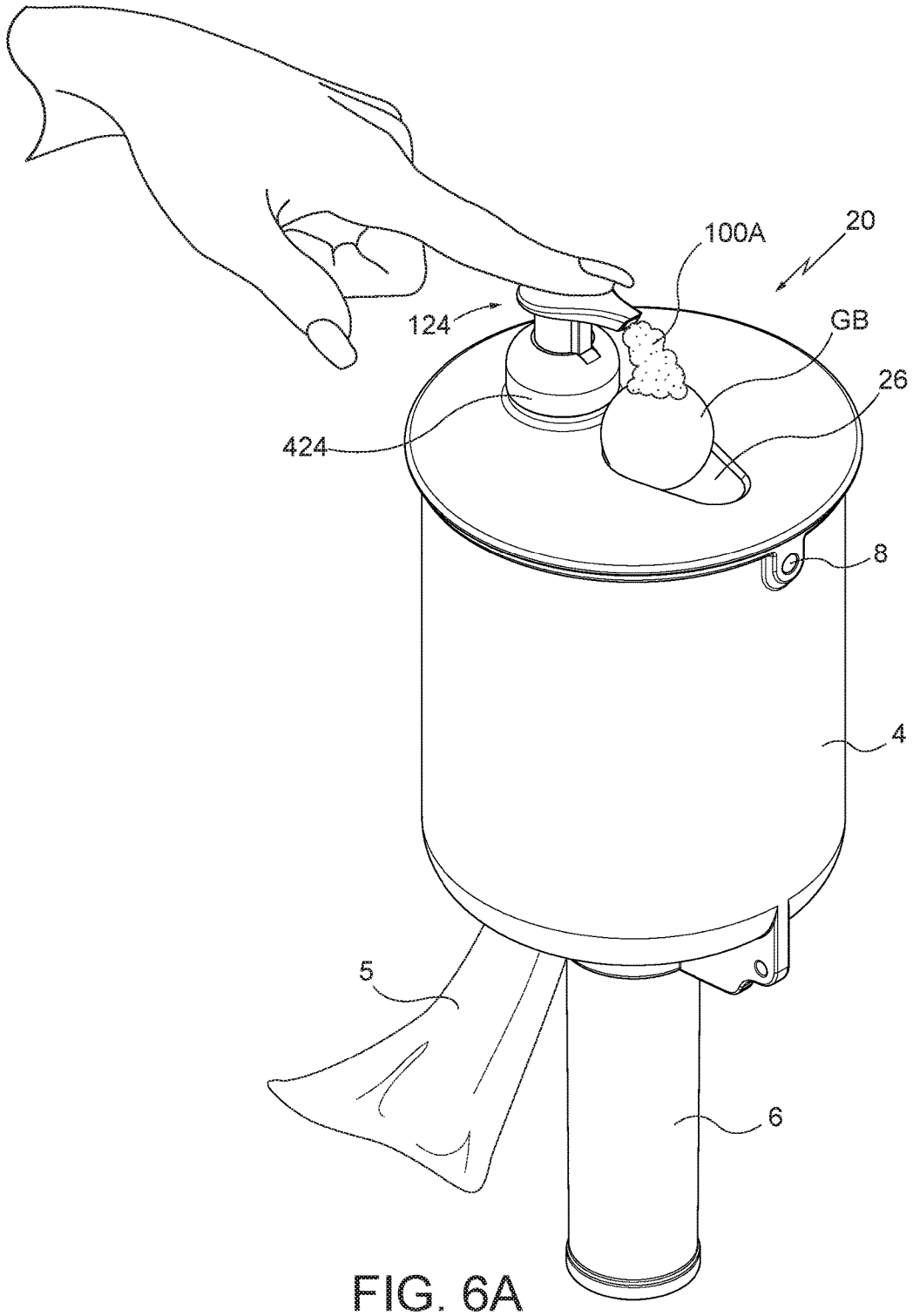
FIGS. 6A-6B depict the process of how a "dirty" golf ball is cleaned using the present invention.
Figure 6B:
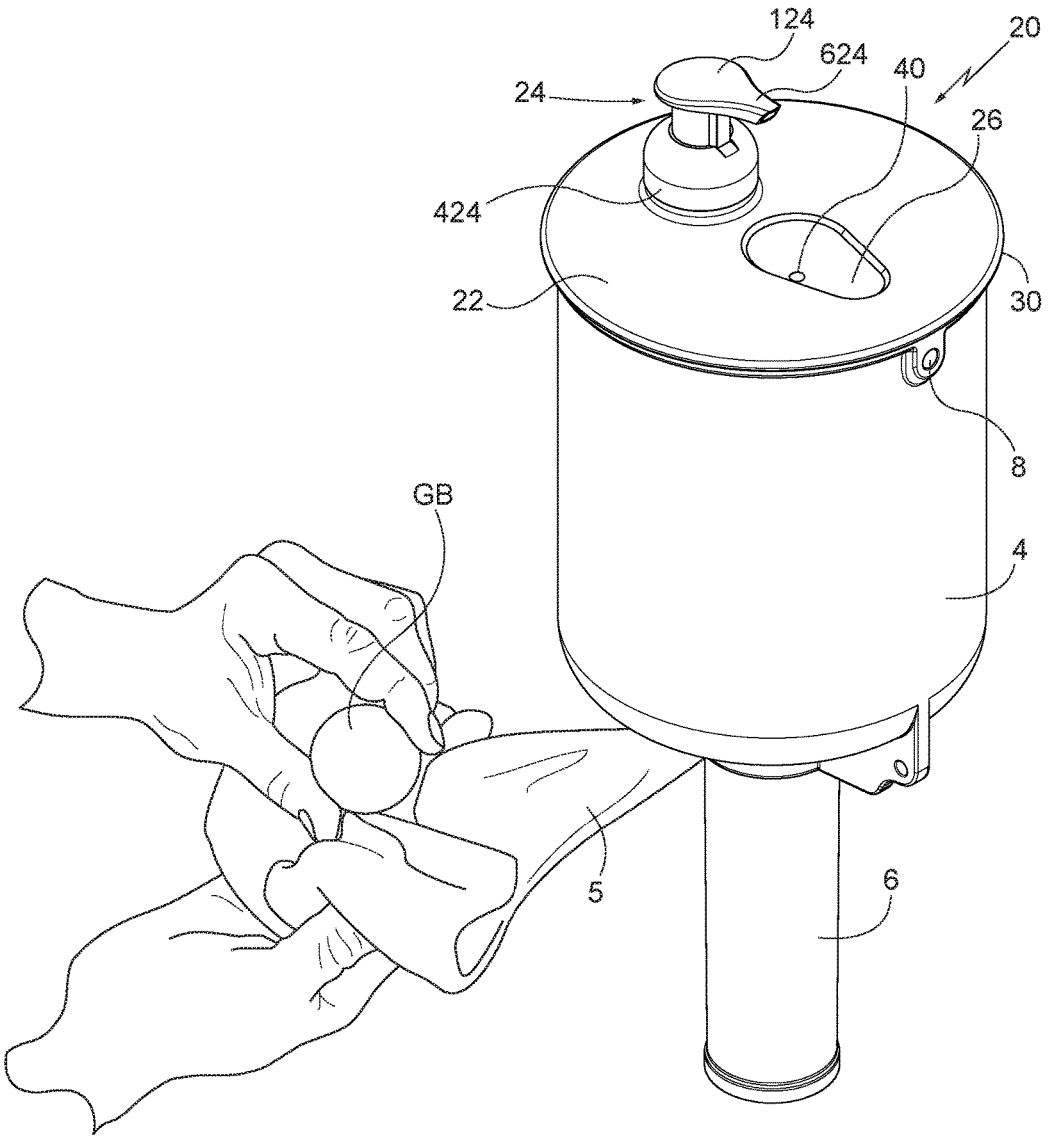
Figure 6C:
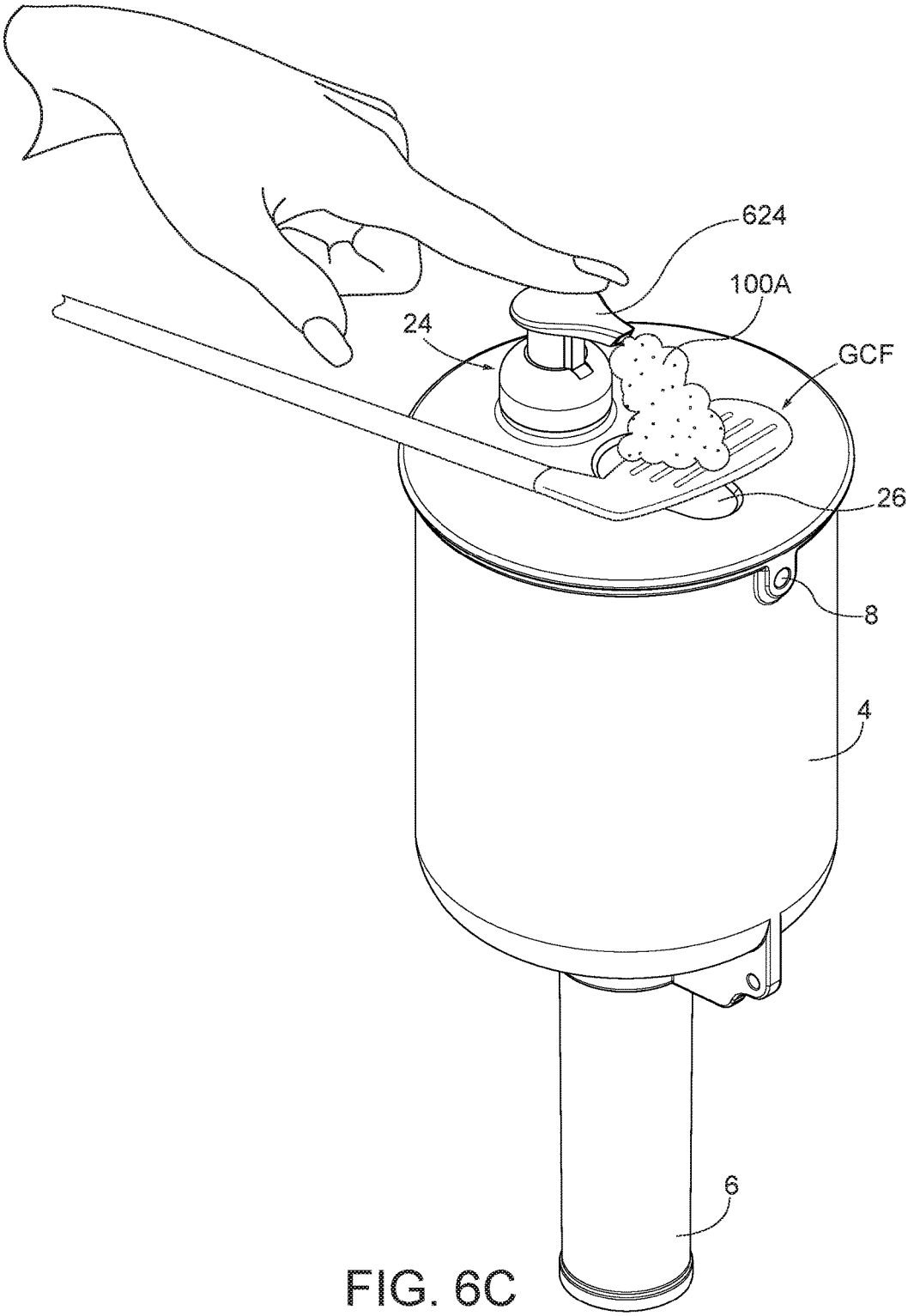
FIGS. 6C-6D depict the process of how a "dirty" golf equipment (e.g., a golf club face) is also cleaned using the present invention.
Figure 6D:
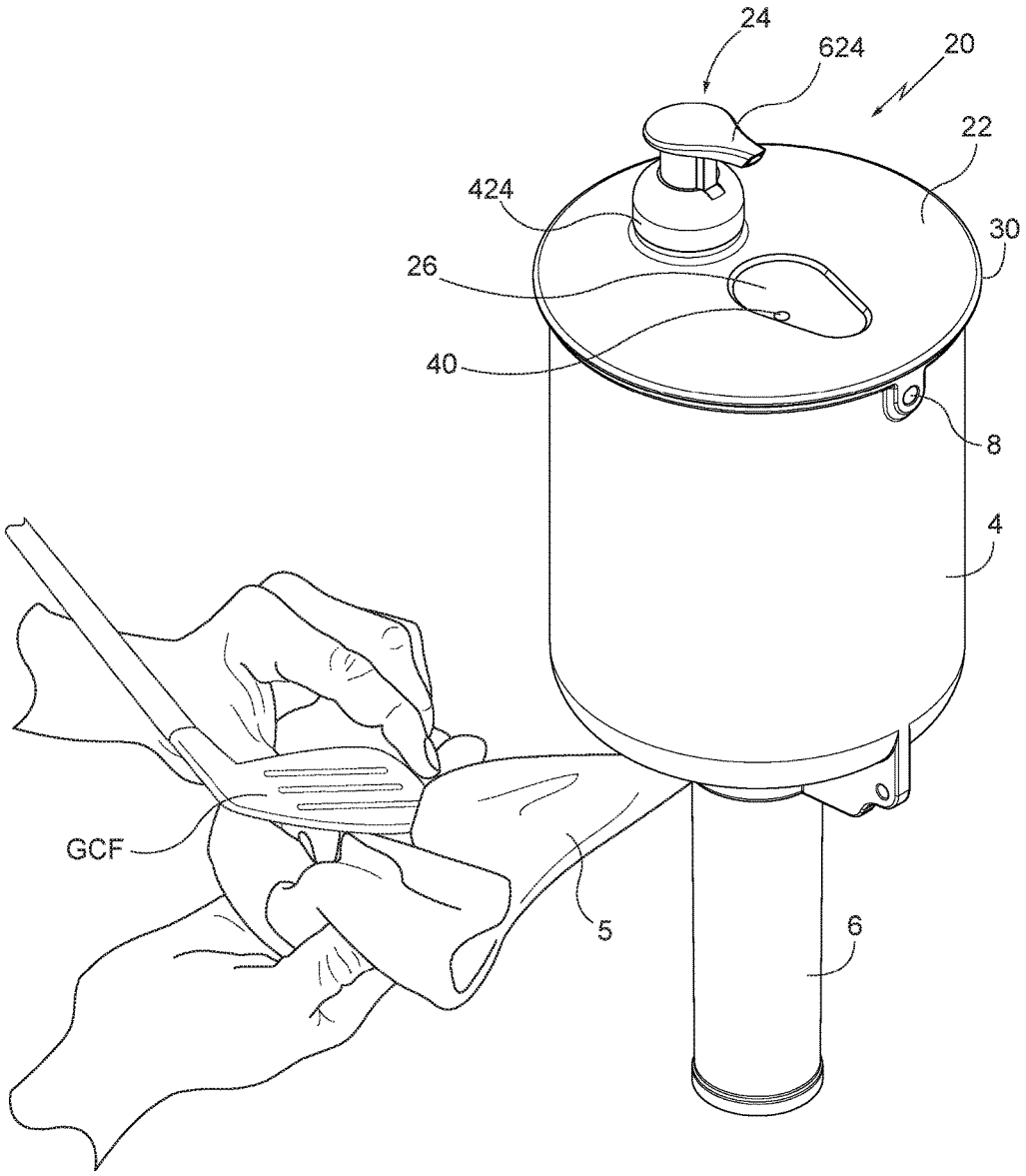

The cleaning solution 100 (e.g., a foaming soap, such as those manufactured by Dial, GOJO Industries, Inc., Kutol Products Company, etc.) is poured into the head 4 before the top 22 is installed on the head 4. When the pump head 124 is depressed by the user, air is injected into the cleaning solution 100, a portion of which is drawn up through the intake tube 524 and a foaming soap solution 100A is dispensed out of the spout 624 and onto the dirty golf ball GB, as shown in FIG. 6A. This is important in that the cleaning solution 100 is removed from the head 4 and applied to the golf ball GB placed in the nest 26. As such, the cleaning solution (i.e., the foaming soap solution 100A) that contacts the dirty golf ball GB becomes "contaminated" but is never returned to the inside of the head 4, thereby preserving the sterility of the cleaning solution 100, unlike the conventional golf ball washer 1. Thus, once the user depresses the pump head 124 (e.g., using his/her finger, his/her palm, etc.) and dispenses the foaming soap solution 100A on the dirty golf ball GB, the golf ball GB becomes covered with the foaming soap solution 100A. The user then removes the ball GB from the cavity 26 and wipes the foaming soap solution 100A from the washed golf ball using the towel(s) 5, as shown in FIG. 6B. This towel-drying action moves the foaming soap around the golf ball GB, thus cleaning and polishing the ball GB. The finger (or otherwise hand)-operated air injection pump 24 infuses air into cleaning solution 100 to produce and dispense a rich, cleaning and polishing foam 100A directly onto the dirty golf ball GB, or dirty golf equipment (e.g., a golf club head, etc., see FIG. 6C).

Figure 5A:
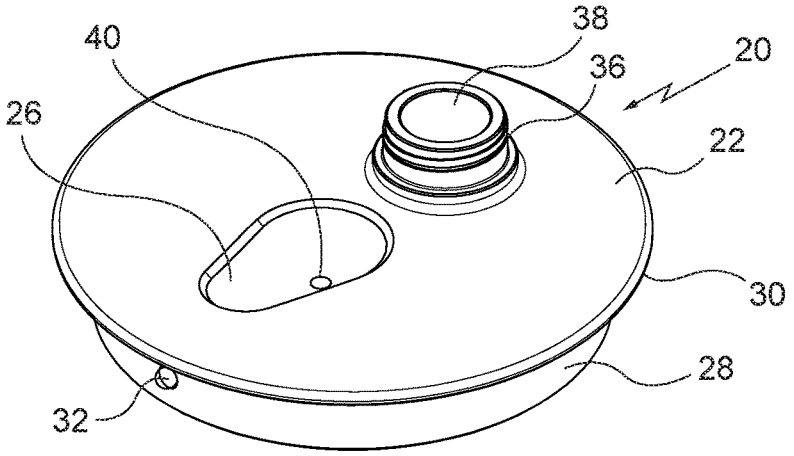
FIG. 5A depicts an isometric view of the top of the present invention, showing a "circular top" for use on a "circular" head of a conventional golf ball washer and without the pump mechanism installed.
Figure 5B:
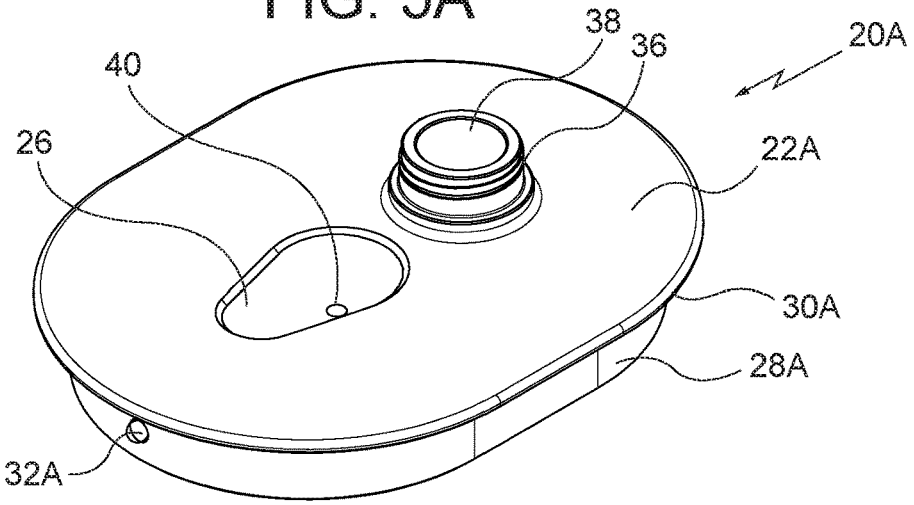
FIG. 5B depicts an isometric view of the top of a second embodiment of the present invention, showing an "oval top" for use on an "oval" head of a conventional golf ball washer and without the pump mechanism installed.
Figure 5C:
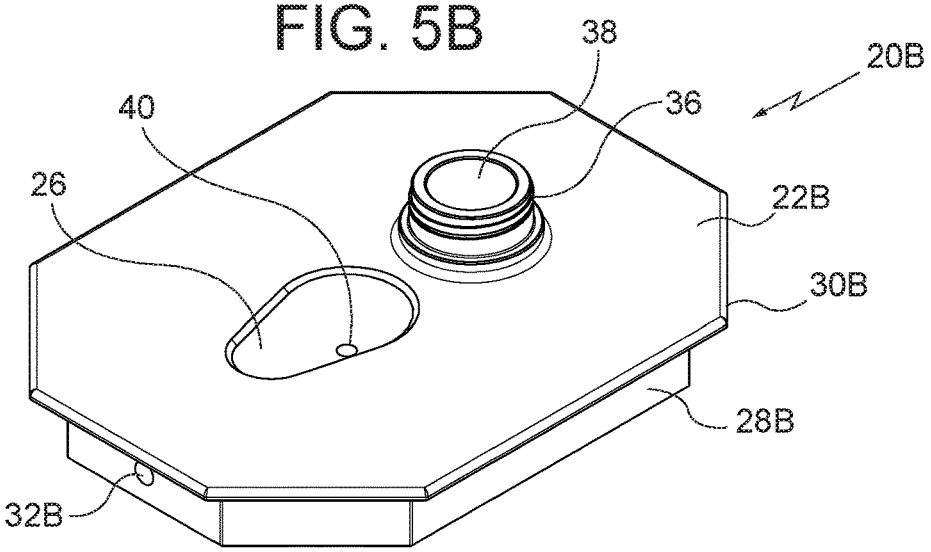
FIG. 5C depicts an isometric view of the top of a third embodiment of the present invention, showing an "octagonal top" for use on an "octagonal" head of a conventional golf ball washer and without the pump mechanism installed.

The present invention 20 discussed so far comprises a replacement top 22 for a "round" head 4. There are other conventional golf ball washers 1 that utilize oval-shaped heads and octagonal-shaped heads. In order to replace the tops of those styles of conventional golf ball washers 1 with the present invention, FIG. 5B depicts a second embodiment 20A that comprises an oval-shaped top 22A/insert 28A and FIG. 5C depicts a third embodiment 20B that comprises an octagonal-shaped top 22B/insert 28B. As such, reference numbers ending in "A" in FIG. 5B and reference number ending in "B" in FIG. 5C correspond to their counterpart in the first embodiment 20 discussed previously. Thus, for example, to make a snug fit in an oval-shaped head, the second embodiment 20A comprises an oval-shaped insert 22A that corresponds to the oval-shaped opening in the corresponding head (not shown); similarly, the third embodiment 20B comprises an octagonal-shaped insert 22B that corresponds to the octagonal-shaped opening in the corresponding head (also not shown). The outer edges of these embodiments, namely, 30A and 30B also form "shoulders" upon which their embodiments rest on top of the correspondingly-shaped heads. The respective apertures 32A and 32B correspond with the aperture 32 in the first embodiment 20, it being understood that the inserts 22A and 22B also comprise apertures on their opposite sides that correspond to aperture 34 in the first embodiment 20.

The present inventions 20-20B are provided as kits such that they can be easily applied to existing golf ball washers as discussed below. Each kit comprises an appropriate top (viz., top 22, top 22A or top 22B), the pump assembly 24 and a container (e.g., a gallon, quart, etc.) of cleaning solution 100. The following replacement procedure utilizes a kit using a circular top 22, it being understood that a similar procedure would be used for a kit for the oval-shaped top 22A or for the octagonal-shaped top 22B.

In particular, an authorized golf course attendant removes the top portion 2 and associated heavy brush assembly 3 of the golf ball washer 1. The contaminated water in the head 4 is drained (e.g., a drain, not shown, in the head 4 is opened, or, alternatively, the entire washer 1 is up-ended and the water is spilled out) in preparation for the delivery of the cleaning solution 100 therein, as shown in FIG. 2B. Once the cleaning solution 100 is poured into the head 4, the top 22 (or 22A or 22B, depending on the style of the head) is then installed over the top of the open head 4 by positioning the insert 28 into the upper portion of the head 4 and having the shoulder 30 rest on the upper surface of the head 4. The attendant makes certain to insert the top 22 such that the apertures 30 and 32 are aligned with the head apertures 8 and 9. A fastener F is then inserted through apertures 8 and 9 (or, alternatively, if those apertures 8/9 already comprise a captured fastener F) and the attendant then tightens this fastener F by hand, or using a tool (e.g., a hex key, pliers, etc.). If not already installed on the threads 36 through the opening 38, the intake tube 524 is fed in through the opening 38 and submerged in the cleaning solution 100 and the cover 424 is threaded onto the threads 36. If the spout 624 is not oriented over the cavity 26, the attendant rotates the spout 624 over the cavity 26.

When a user wishes to wash his/her dirty golf ball GB, the user places the ball GB in the nest 26 and depresses the pump head 124 to dispense the foaming soap 100A on the dirty ball GB in the nest 26. The cleaning solution 100 in the head 4 is an eco-friendly, sanitizing foaming soap solution. As mentioned previously, once the foaming soap 100A is dispensed over the dirty golf ball GB, the user dries the ball GB with the towel 5 and in doing so also moves the soap 30 around the ball GB and cleans it in the process in a more effective, eco-friendly manner, while sanitizing his/her own hands.

Similarly, the user may wish to clean other related golf equipment, e.g., the golf club head, the golf club grip, or any number of other related golf equipment. By way of example only, FIGS. 7A-7B depict a golfer using the present invention 20 to clean a dirty golf club face GCF. In particular, the user need only position the object to be cleaned underneath the spout 624, typically over the nest 26 and depress the pump head 124 to dispense a foaming soap solution 100A on the dirty golf club face GCF. The golfer then uses the towel 5 to disperse the foaming soap solution 100A over the dirty golf club face GCF and wipe it clean with the towel 5.

It is within the broadest scope of the present invention 20-20B to include all types of cleaning solutions and associated pump assemblies for dispensing the cleaning solution. For example, rather than using a cleaning solution 100 that becomes a "foamed" soap solution upon dispensing, other cleaning fluids that remain in a liquid state when dispensed by their associated pump assemblies are certainly within the broadest aspect of the inventions 20-20B.

Thus, the present invention 20 provides for an easy device for converting any conventional golf ball washer 1 into an "eco-friendly" ball washer. Because of its two part design (viz., the top 22 and the pump assembly 24) the present inventions 20-20B need no repair or maintenance and use sanitizing foaming soap (not contaminated water) dispensed in small amounts (via the limited dispense due to the activation of the pump handle 124 once). As a result, the present inventions 20-20B need refilling much less often, e.g., refills are required only once or twice over a typical multi-month golf season.

While the invention has been described in detail and with reference to specific examples thereof, it will be apparent to one skilled in the art that various changes and modifications can be made therein without departing from the spirit and scope thereof.

What is claimed is:

1. A device for converting a golf ball washer having a lid with a brush assembly installed on a golf ball washer head into a multi-golf item cleaning device, said device comprising:

a top, adapted for replacing the lid and the brush assembly, said top comprising a pump assembly having an intake line that is positioned within the head containing a cleaning solution, said top comprising an insert having an upper planar surface, said insert being downwardly-depending from said upper planar surface in a uniform thickness and which is positioned within an opening in the head containing said cleaning solution, said upper planar surface and said insert comprising a nest that is integrally formed therein, said nest receiving a golf ball therein, said upper planar surface comprising an outer edge that is positioned on top of the head, said pump assembly being releasably secured within said insert and comprising a spout for delivering a predetermined amount of said cleaning solution to the golf ball deposited in said nest positioned under said spout, said nest comprising a drain passageway from a lowest point in said nest and through said insert for preventing the accumulation of the cleaning solution in said nest.

2. The device of claim 1 wherein said pump assembly converts said cleaning solution into a predetermined amount of foaming soap solution that is delivered to the golf ball in said nest under the spout when the pump assembly is activated.

3. The device of claim 1 wherein said drain passageway also prevents the accumulation of rain water in said nest.

4. The device of claim 1 wherein said outer edge of said upper planar surface forms a shoulder that rests on a top edge of the head.

5. The device of claim 1 wherein said insert comprises a pair of apertures located on opposite sides of said insert, said apertures being aligned with apertures in the head when said top is installed on the head.

6. The device of claim 1 wherein said top is adapted for releasably securing to the head.

7. The device of claim 6 wherein said top comprises a raised opening having threads, said raised opening adapted to engage corresponding threads on said pump assembly for releasably securing said pump assembly to said top.

8. The device of claim 1 wherein the head has a circularly-shaped opening and wherein said insert is circularly-shaped to correspond to said circularly-shaped opening of the head.

9. The device of claim 1 wherein the head has an oval-shaped opening and wherein said insert is oval-shaped to correspond to said oval-shaped opening of the head.

10. The device of claim 1 wherein the head has an octagonal-shaped opening and wherein said insert is octagonal-shaped to correspond to said octagonal-shaped opening of the head.

11. A kit for converting a golf ball washer having a lid with a brush assembly installed on a golf ball washer head into a multi-golf item cleaning device, said kit comprising:

a top, adapted for replacing the lid and the brush assembly, said top comprising a pump assembly having an intake line that is positioned within the head, said top comprising an insert having an upper planar surface, said insert being downwardly-depending from said upper planar surface in a uniform thickness and which is positioned within an opening in the head that contains a cleaning solution therein, said upper planar surface and said insert comprising a nest that is integrally formed therein, said nest receiving a golf ball therein, said upper planar surface comprising an outer edge that is configured for being positioned on top of the head, said nest comprising a drain passageway from a lowest point in said nest and through said insert for preventing the accumulation of the cleaning solution in said nest; and a container of said cleaning solution, said cleaning solution being poured into the head before the top is installed on the head.

12. The kit of claim 11 wherein the head has a circularly-shaped opening and wherein said top comprises an insert that is circularly-shaped to correspond to said circularly-shaped opening of the head.

13. The kit of claim 11 wherein the head has an oval-shaped opening and wherein said top comprises an insert that is oval-shaped to correspond to said oval-shaped opening of the head.

14. The kit of claim 11 wherein the head has an octagonal-shaped opening and wherein said top comprises an insert that is octagonal-shaped to correspond to said octagonal-shaped opening of the head.

* * * * *